US006612456B1

(12) United States Patent
Hundley et al.

(10) Patent No.: US 6,612,456 B1
(45) Date of Patent: Sep. 2, 2003

(54) DRINK-THROUGH CUP LID HAVING SELECTIVELY INWARDLY AND OUTWARDLY ROTATABLE HINGED PORTION

(75) Inventors: Bobby V. Hundley, Glendale, AR (US); Joseph H. Quatmann, Phoenix, AR (US)

(73) Assignee: Wincup Holdings, Inc., Phoenix, AZ (US)

( * ) Notice: Subject to any disclaimer, the term of this patent is extended or adjusted under 35 U.S.C. 154(b) by 0 days.

(21) Appl. No.: 09/689,963

(22) Filed: Oct. 12, 2000

(51) Int. Cl.[7] ..... B65D 51/18

(52) U.S. Cl. ..... 220/254.3; 220/254.1; 220/254.5; 220/268; 220/711; 220/712; 220/716; 220/780; 229/404; 229/906.1

(58) Field of Search ..... 215/387; 229/404, 229/906.1; 220/254, 837, 703, 711, 712, 713, 716–718, 780, 268, 838, 254.1, 254.3, 254.5, 254.7; 222/541.9, 541.6, 541.5, 556

(56) References Cited

U.S. PATENT DOCUMENTS

| | | | | | |
|---|---|---|---|---|---|
| 3,797,696 | A | | 3/1974 | Dibrell | |
| 3,927,794 | A | | 12/1975 | Erdman | |
| 4,056,210 | A | | 11/1977 | Boyle | |
| 4,081,103 | A | | 3/1978 | Zoellick | |
| 4,106,660 | A | | 8/1978 | Boyle | |
| 4,113,135 | A | | 9/1978 | Yamazaki | |
| 4,127,212 | A | | 11/1978 | Waterbury | |
| 4,138,033 | A | | 2/1979 | Payne et al. | |
| 4,184,604 | A | | 1/1980 | Amberg et al. | |
| 4,190,174 | A | | 2/1980 | Haimowitz | |
| 4,206,854 | A | | 6/1980 | Takami | |
| 4,210,256 | A | | 7/1980 | Amberg et al. | |
| 4,245,752 | A | | 1/1981 | Prueher | |
| 4,319,692 | A | * | 3/1982 | Gundlach | 220/268 |
| 4,350,260 | A | | 9/1982 | Prueher | |
| 4,377,244 | A | * | 3/1983 | Rossetti | 220/268 |
| 4,394,928 | A | | 7/1983 | Philip | |
| 4,412,629 | A | | 11/1983 | Dart et al. | |
| 4,460,103 | A | * | 7/1984 | Rama et al. | 220/254 |
| 4,553,684 | A | * | 11/1985 | Bennett | 220/268 |
| 4,582,214 | A | | 4/1986 | Dart et al. | |
| 4,615,459 | A | * | 10/1986 | Clements | 220/254 |
| 4,738,373 | A | * | 4/1988 | DeParales | 220/254.3 |
| 4,741,450 | A | | 5/1988 | Braude | |
| 4,747,509 | A | | 5/1988 | Florkiewicz et al. | |
| 4,949,865 | A | | 8/1990 | Turner | |
| 5,062,542 | A | | 11/1991 | Morton | |
| 5,090,584 | A | | 2/1992 | Roberts et al. | |
| 5,111,961 | A | | 5/1992 | Van Melle | |
| 5,183,172 | A | | 2/1993 | Boller | |
| 5,335,812 | A | * | 8/1994 | Boller | 220/713 X |
| 5,490,609 | A | | 2/1996 | Lane et al. | |
| 5,503,289 | A | | 4/1996 | Fox | |
| 5,509,568 | A | | 4/1996 | Warden et al. | |
| 5,535,911 | A | * | 7/1996 | Cortez | 220/268 |
| 5,645,191 | A | | 7/1997 | Neville | |
| 5,699,927 | A | | 12/1997 | Lane et al. | |
| 5,799,814 | A | | 9/1998 | Schaefer et al. | |
| 5,833,112 | A | * | 11/1998 | Pape et al. | 222/541.6 X |
| 5,839,601 | A | * | 11/1998 | Van Melle | 220/712 |
| 5,894,950 | A | * | 4/1999 | Kick | 220/268 |
| 5,947,323 | A | * | 9/1999 | Freek et al. | 220/254 X |
| 6,089,397 | A | * | 7/2000 | Van Melle | 220/712 X |

* cited by examiner

*Primary Examiner*—Robin Hylton
(74) *Attorney, Agent, or Firm*—Duane Morris LLP

(57) ABSTRACT

A drink-through cup lid, adapted to matingly engage the upper peripheral edge of a drinking cup so as to selectively maintain the lid in a covering relationship on the cup, includes a rim engaging portion and a central cover portion. The central cover portion further has a hinged portion which is selectively depressible to so as to provide a drinking opening in the lid, the hinged portion is biased so as to selectively substantially return to its normally closed position within the plane of the central cover portion upon removal of pressure there-against. The hinged portion includes a hollow raised tab integrally formed thereon. A recess which is integrally formed on the central cover portion of the lid is adapted to selectively receive the raised tab of the hinged portion in detachable locking engagement.

9 Claims, 10 Drawing Sheets

DRINK-THROUGH CUP LID HAVING SELECTIVELY INWARDLY AND OUTWARDLY ROTATABLE HINGED PORTION

FIELD OF THE INVENTION

The invention relates generally to cup lids, and more particularly to a drink-through cup lid having a reversible opening.

DESCRIPTION OF THE RELATED ART

Fast food restaurants, coffee shops, convenience stores and the like, typically distribute beverages in disposable drinking cups. These cups are often provided with drink-through lids having reversible openings, which permit the consumption of liquids contained therein, while at the same time preventing unwanted spillage. Drink-through lids with reversible openings are especially desirable when distributing hot beverages, such as coffee, tea, hot chocolate and the like.

Various drink-through lid designs incorporating reversible openings are known. For example, U.S. Pat. No. 5,490,609 ('609) and U.S. Pat. No. 5,699,927 ('927) each disclose a lid having a drinking opening and a hinged closure member integrally formed therewith. The hinged closure member has a radial dimension greater than that of the drinking opening to permit an outward marginal edge portion of the closure member to be trapped between the rim of the drinking cup and an overlying part of the lid. The hinged closure member further includes a raised tab which is received in a complementary recess formed in the lid, when the hinged closure member is rotated outward one hundred eighty degrees (180) about its integral hinge to expose the drinking opening.

Other cup lid designs that incorporate reversible openings, include U.S. Pat. No. 4,412,629 ('629), which provides a downwardly depressible tab portion. The tab portion includes a hollow lip-engaging corrugated buttress to insulatively engage a user's upper lip pressed thereagainst. The buttress member also selectively acts to bias the tab portion back into its normally closed position within the horizontal plane of the lid when lip pressure is removed therefrom.

The present inventors have identified several limitations in aforementioned prior art lid designs. One drawback of the '609 and '927 patent designs is the hinged portion of each lid is rotatable only in one direction, i.e, up and out of the plane of the lid. The hinged portions cannot be resiliently depressed into the lids. Thus, the hinged portions each have only one mode of operation in which they must be opened and closed manually. Another disadvantage of these designs is their integral hinges bias the tabs out of the lid recesses when the tabs of the hinged portions are engaged therein. Still another disadvantage is their hinged closure members must be gripped with both a thumb and forefinger for manipulation. Yet another disadvantage is the hinged portions of these lid designs are formed by creating a break in the peripheral rim engaging portion of the lids, which may compromise the integrity of the seal between the lid and a cup rim.

The '629 patent design also is limited to one mode of operation—the tab only is resiliently depressible into the lid. The tab of the '629 patent is not adapted for rotation out of the plane of the cover portion of the lid.

Thus, it would be desirable to provide a lid design having multiple modes of operation, wherein a hinged portion of the lid could be either resiliently pressed down into the lid, or manually rotated out of the plane of the lid, to provide a drinking opening. The preferred lid design would include a protruding tab that detachably lockingly engages a recess in the lid, and is retained in the recess by a biasing force of an integrally formed hinge. The ideal lid design would also be simple and hence cost effective to manufacture.

SUMMARY OF THE INVENTION

The invention provides a drink-through cup lid adapted to matingly engage the upper peripheral edge of a drinking cup so as to selectively maintain the lid in a covering relationship on the cup. The lid includes a rim engaging portion and a central cover portion. The central cover portion further includes a hinged portion which is selectively depressible to so as to provide a drinking opening in the lid, the hinged portion biased so as to selectively substantially return to its normally closed position within the plane of the central cover portion upon removal of pressure there-against. The hinged portion includes a hollow raised tab integrally formed thereon. A recess which is integrally formed on the central cover portion of the lid is adapted to selectively receive the raised tab of the hinged portion.

Another aspect of the invention is a method for reversibly providing an opening in a drink-through lid including the steps of: securing the lid to the rim of a cup, releasing from the surrounding lid material a tab thereby defining an opening in the lid, and rotating the tab about a hinge into nested engagement in a recess in the lid, wherein the hinge biases the tab in the recess.

BRIEF DESCRIPTION OF THE DRAWINGS

Other objects, advantages and novel features of the invention will become more apparent from the following detailed description of the invention when considered in conjunction with the accompanying drawings wherein.

DETAILED DESCRIPTION

Figure 1:
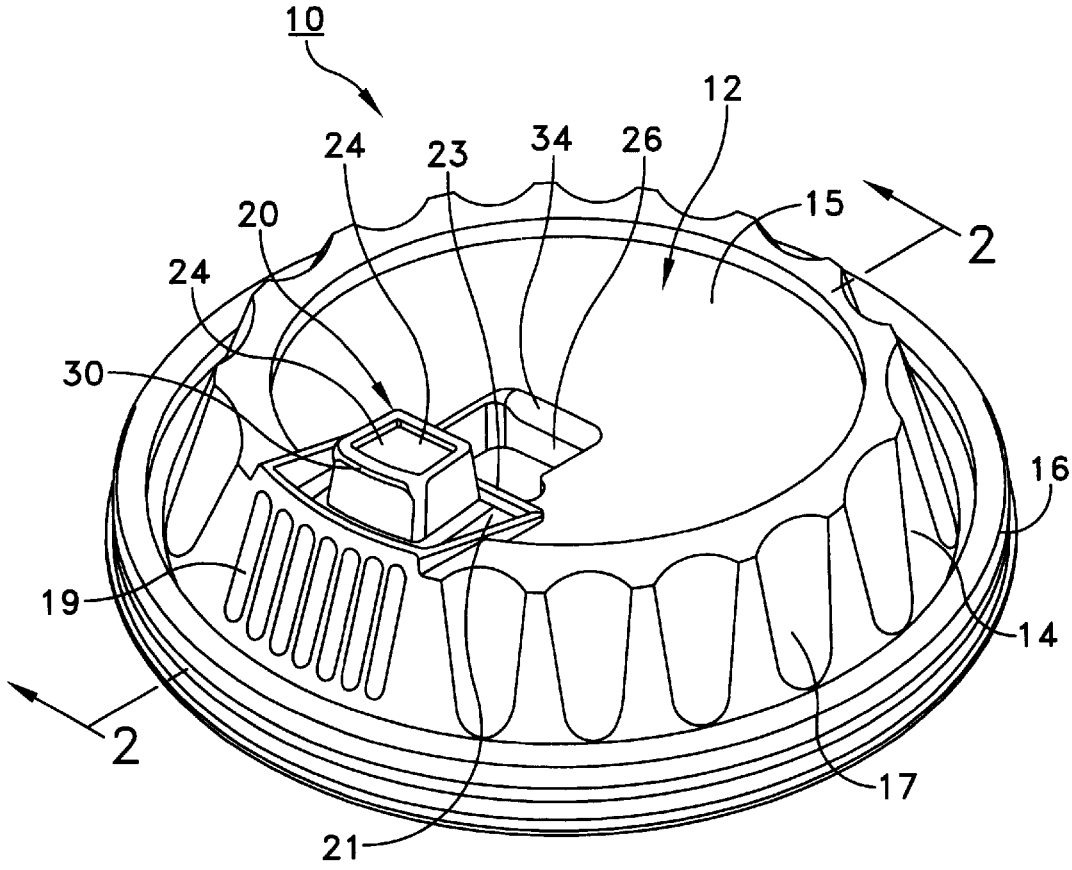
FIG. 1 is a front isometric view of an embodiment of a drink-through cup lid design according to the invention.
Figure 2:
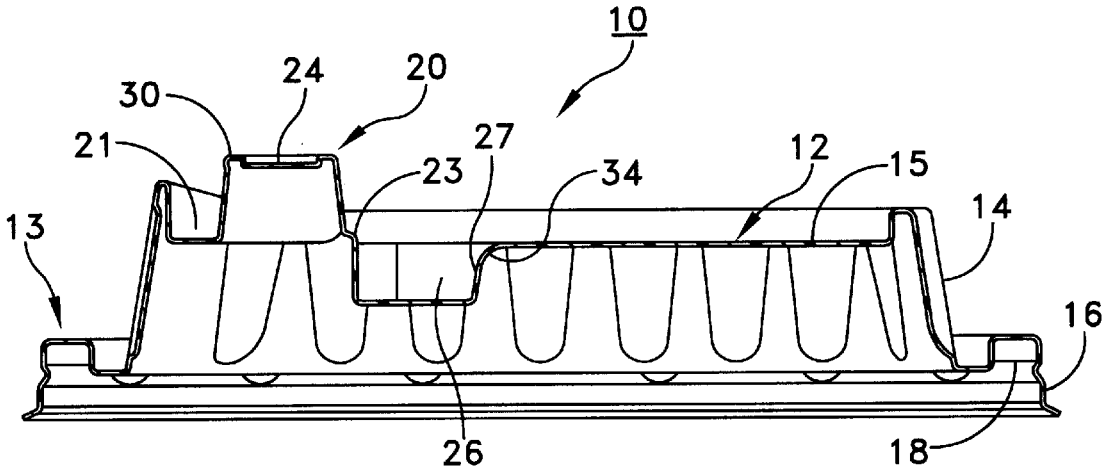
FIG. 2 is a cross sectional view of the lid shown in FIG. 1, taken along line 2—2.
Figure 3:
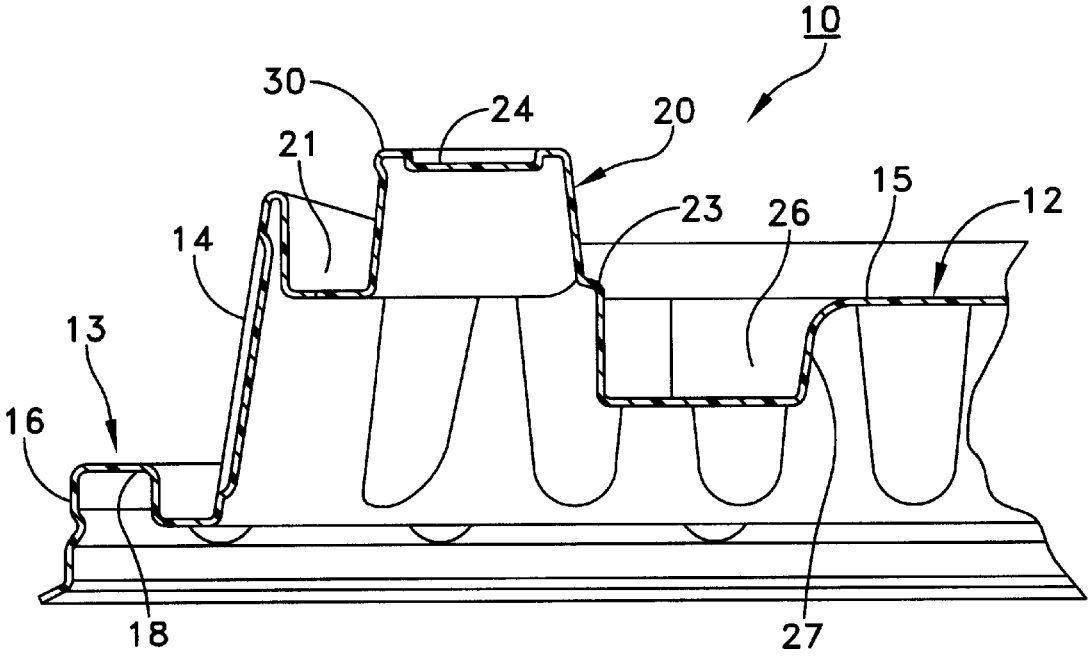
FIG. 3 is a partial detail view of the cross section shown in FIG. 2.
Figure 4:
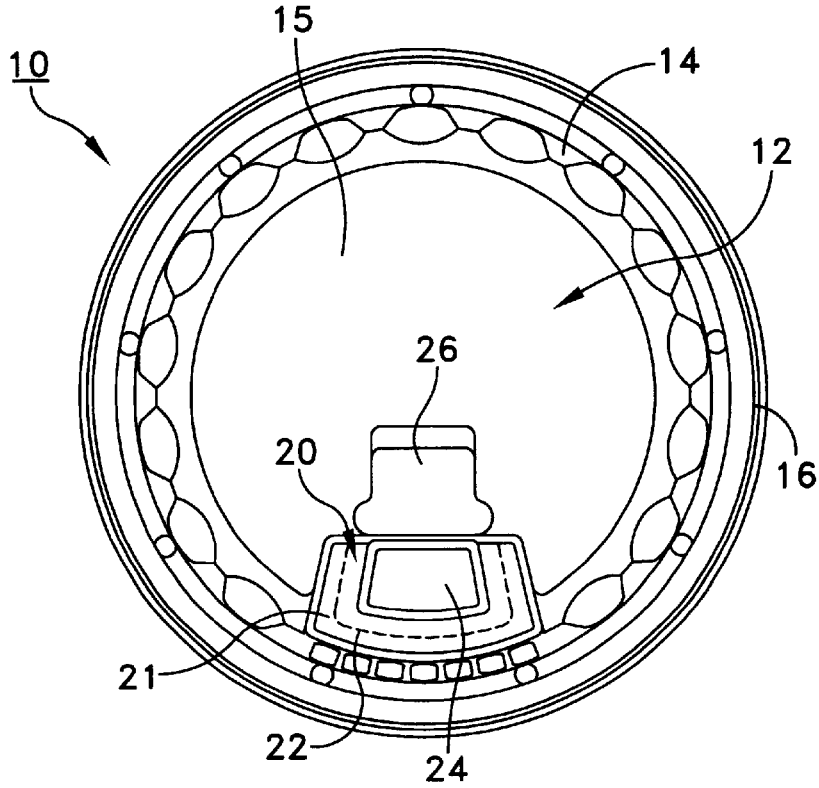
FIG. 4 is a top plan view of the lid.
Figure 5:
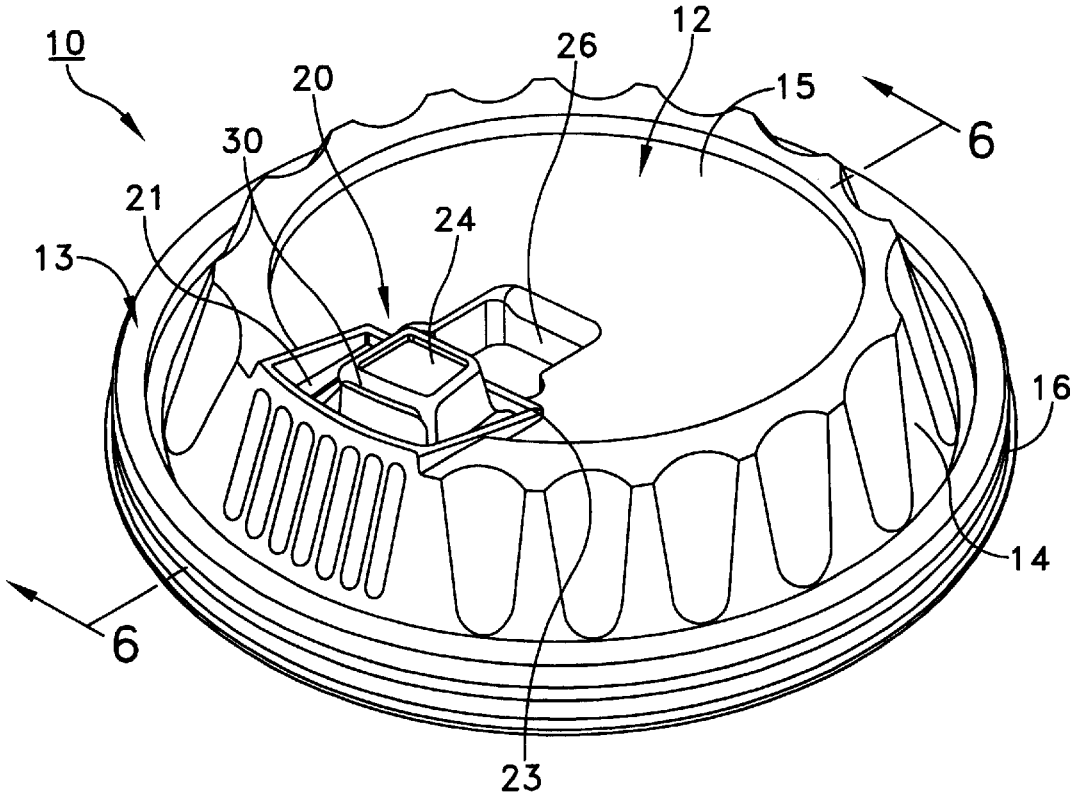
FIG. 5 is a front isometric view of an embodiment a cup lid design according to the invention, with the hinged portion rotated inward to create an opening in the lid.

FIGS. 1 and 2, show a drink-through lid 10 according to the invention, for use with a drinking container or cup, the lid 10 preferably being made of thermoplastics, such as, polystyrene, polypropylene and polyethylene terephthalate (PET). Lid 10 includes a central cover portion 12 and a rim engaging portion 13. The central cover portion 12 of the lid 10 is defined by a generally frusto-conical shape which includes a peripheral wall 14 and a generally planar circular top portion 15. Wall 14 includes a plurality of circumferentially disposed corrugations 17. These wide corrugations 17 increase the structural rigidity of lid 10. In addition, these corrugations impede rotation of the liquid and thereby tend to prevent the liquid from splashing out of the drinking opening 32 (described below and shown in FIG. 6) of lid 10.

A series of narrow corrugations 19 are also provided in wall 14, proximate the drinking opening 32 of the lid 10. These narrow corrugations 19 serve to insulate the user's lower lip from discomfort due to the hot liquid in the cup bearing against the internal surface of the lid 10. The corrugations 19 limit contact between the user's lower lip and the cup lid 10, while providing increased surface area for improved heat dissipation. At the same time, air may be temporarily trapped in the corrugations providing further insulative capacity.

The rim engaging portion 13 includes a circumferential depending skirt 16 and an internal downward facing annular groove 18, adapted to retainably engage the peripheral rim of a drinking container upon which the lid 10 is mounted.

A hinged portion 20 is formed in the central cover portion 12, the hinged portion 20 being defined by a substantially U-shaped slit 22 or line of weakened cross-section in or through the cover portion 12. The U-shape slit 22 is formed facing inwardly toward the center of the lid.

A selectively lip-engaging hollow tab 24 is integrally formed in the hinged portion 20. As will be hereinafter described in greater detail, in one mode of operation the upper lip of the user engages and selectively exerts pressure against the tab 24 so as to depress the hinged portion 20 inwardly so as to provide a drinking opening.

In the exemplary embodiment shown, the tab 24 is a hollow generally cube shaped, open bottomed member, which protrudes above the plane of the cover portion 12 of the lid 10. Alternatively, the protruding tab 24 may comprise any shape that can be engaged by the user to either depress the hinged portion 20 inward, or to rotate the hinged portion 20 up and out of the plane of the cover portion 12 of the lid to provide a drinking opening therein. It is further contemplated that the tab may include a combination of ridges, grooves or corrugations in order to increase the heat-dissipating surfaces of the tab 24. Thus configured, the tab 24 makes insulative contact with the upper lip of the user, thereby protecting the user's upper lip from discomfort due to the hot liquid bearing against the bottom surface of the lid 10 during drinking.

Hinged portion 20 resides in a well 21 provided in central cover portion 12. The well 21 directs excess liquid back into the drinking opening 32 of the cup. In addition, the well 21 insulates the lips of the user from direct contact with the sharp die-cut edges of the drinking opening 32, to provide a comfortable drinking experience.

As shown generally throughout FIGS. 1–16, a recess 26 is integrally formed on the cover portion 12 of the lid 10, adjacent hinged portion 20. Recess 26 is positioned toward the center of cover portion 12 from hinged portion 20, and includes a foremost edge that is defined by the hinge 23 of hinged portion 20. The recess 26 has a shape which is adapted to selectively receive tab 24. In the embodiment shown, the shape of the recess 26 is substantially complementary to the shape of the tab 24, i.e., generally cubical. Further, the front wall of tab 24 is provided with a protruding rib 30 which engages the back wall 27 of recess 26 when tab 24 is inserted therein, thereby selectively detachably locking hinged portion 20 in an open position.

A drink-through lid according to the invention has a preferred diameter of between about 3" and 5". The drinking opening 32 provided in the central cover portion of the may be approximately 0.750"×0.575". The preferred tab size is 0.5"×0.375"×0.350", and is shaped to engage a complementary recess of substantially equivalent dimensions. The height of central cover portion 12 is sized such that the bottom of a recess 26 integrally formed therein is above the plane of a rim engaging portion 13 of the lid 10, and is preferably about 0.385". It will be understood that the invention is not limited to the precise dimensions described herein, which are intended only to illustrate a preferred embodiment thereof.

In operation, the drink-through lid 10 is selectively snap-mounted on any desired drinking cup, with the annular groove 18 of the lid engaging the upper peripheral edge of the cup. With lid 10 properly engaged with the cup, there are two ways a user may drink from the cup.

Figure 6:
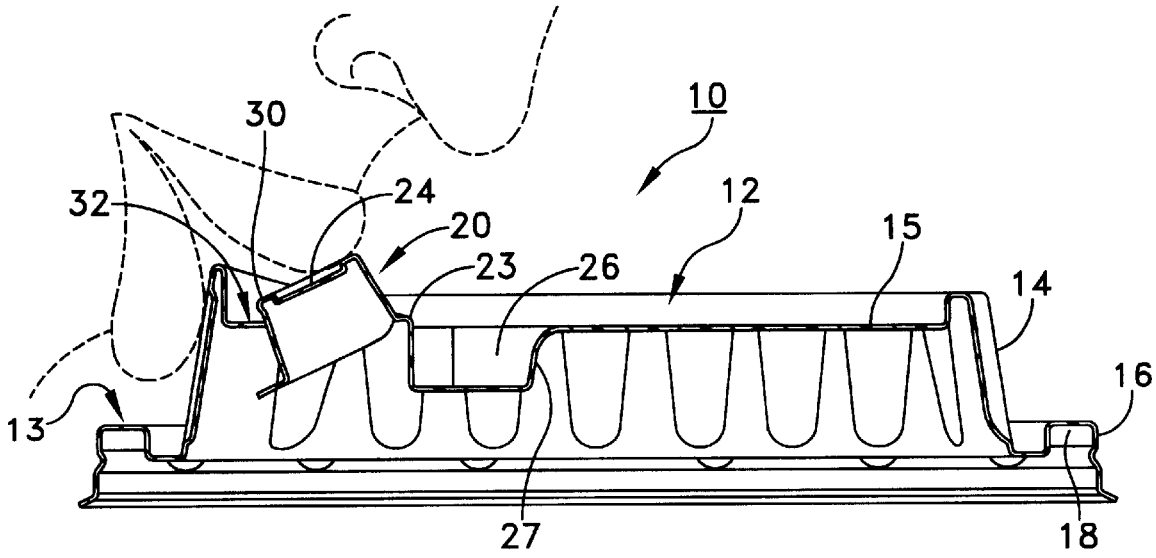
FIG. 6 is a cross sectional view of the lid shown in FIG. 5, taken along line 6—6.
Figure 7:
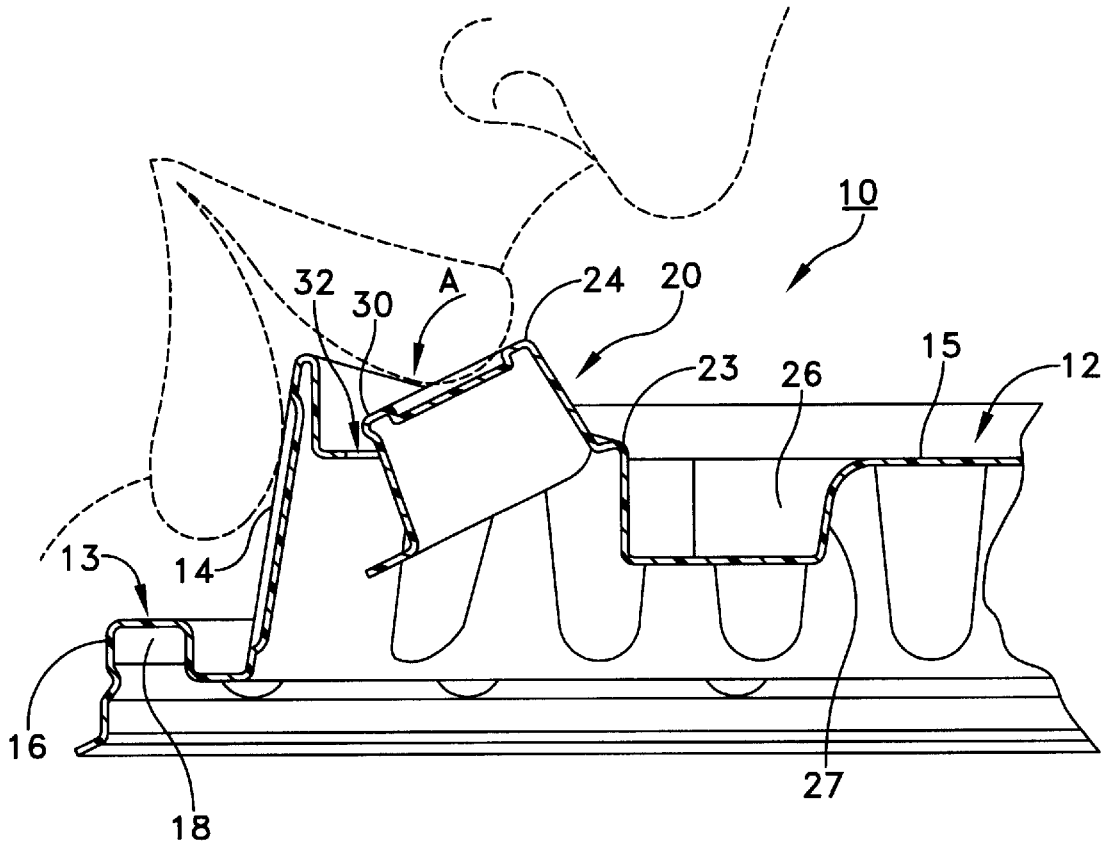
FIG. 7 is a partial detail view of the cross section shown in FIG. 6.

In a first scenario, the user raises the cup to his mouth and begins tilting the cup so that the lid 10 moves into engagement with the user's lips. In this position, the upper lip of the user engages the protruding tab 24 of hinged portion 20 and the lower lip of the user engages the corrugated wall 14 of the lid 10. Referring to FIGS. 6 & 7, as the upper lip of the user presses against the protruding tab 24, the hinged portion 20 is depressed below the plane of the cup lid 10, in a direction indicated in FIG. 7 by arrow "A," creating an opening 32 in the lid 10 through which fluid flows into the mouth of the user.

The tipping of the cup causes the liquid to flow against the lid 10. In the case of hot beverages such as, coffee, tea, hot chocolate and the like, the lips of the user may become uncomfortable due to the hot liquid bearing against the internal surface of the lid 10. In the present configuration, however, the corrugations 19 provided in the peripheral wall 14 of the lid 10 provide increased surface area to dissipate the heat of the liquid flowing there-against, thereby reducing the likelihood that a user drinking a hot beverage will experience discomfort, particularly on his lower lip. Air pockets may also be temporarily formed in the corrugations 19 as well as in tab 20, further insulating the users's lips and mouth.

After the user has taken a sip or drink of liquid he removes the cup away from his mouth, thereby removing his upper lip from contact with tab 24. With the pressure from the user's upper lip removed from the tab, the hinged portion 20 springs back to its normally closed position in the plane of central cover portion 12. At the same time, the hinged portion remains below the plane of the lid 10, because of biasing provided by hinge 23. This quick closing action prevents accidental spillage.

In a second mode of operation, the hinged portion 20 of the lid may be rotated up and out of the plane of the cup lid 10, before the user raises the cup to his mouth, thereby creating an opening 32 through which fluid can flow through the lid 10. With the hinged portion 20 in a closed position, tab 24 protrudes substantially from the plane of the cup lid 10. This feature permits the user to easily open the hinged portion 20 of the cup lid 10. For example, by engaging the foremost edge at 30 of tab 24 with a thumb, a user can gain enough mechanical leverage to overcome the U-shaped weakend cross section of the hinged portion and/or the resilient bias of integrally formed hinge 23, to flip up the hinged portion 20 of the cup lid 10. Once lifted out of the plane of the cup lid, the user can continue to rotate the hinged portion 20 approximately 180 degrees about the hinge 23, until the now inverted tab 24 is received in complementary recess 26.

Figure 8:
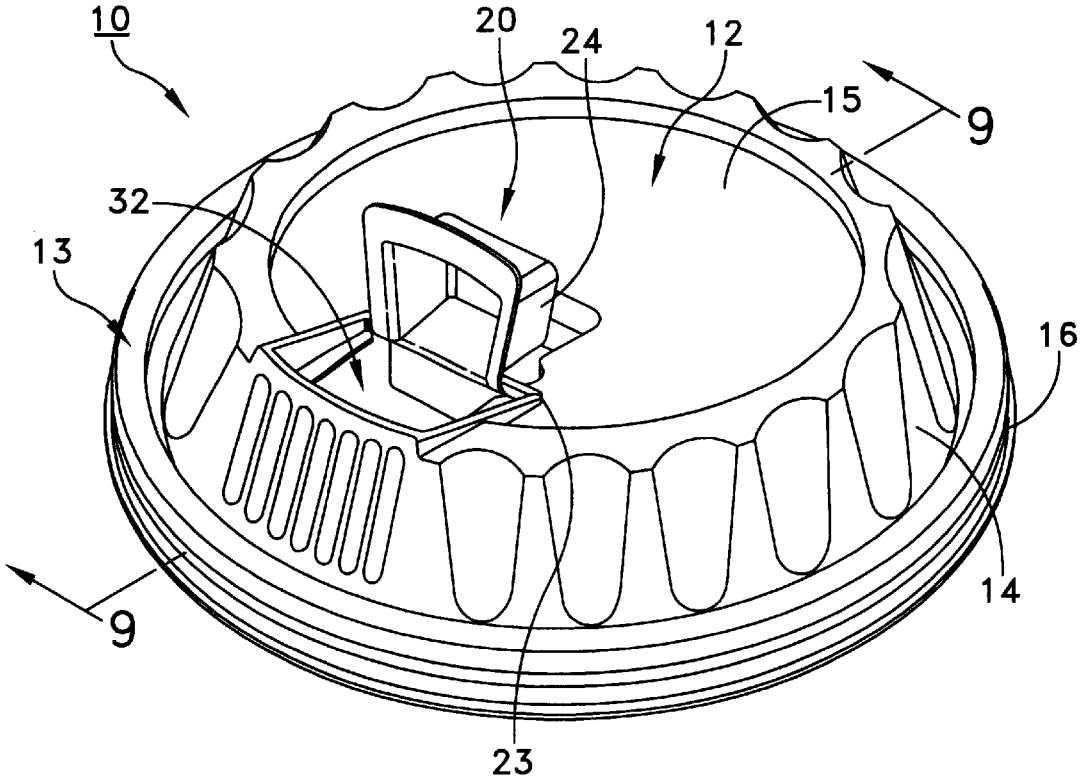
FIG. 8 is a front isometric view of a cup lid design according to the invention, with the hinged portion rotated 90 degrees out of the plane of the lid.
Figure 9:
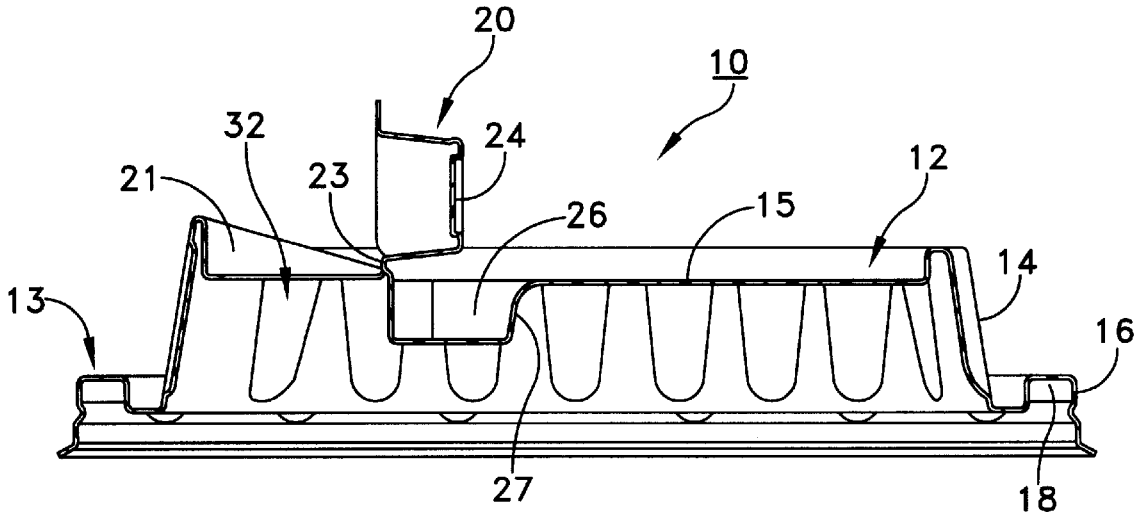
FIG. 9 is a cross sectional view of the lid shown in FIG. 8, taken along line 9—9.
Figure 10:
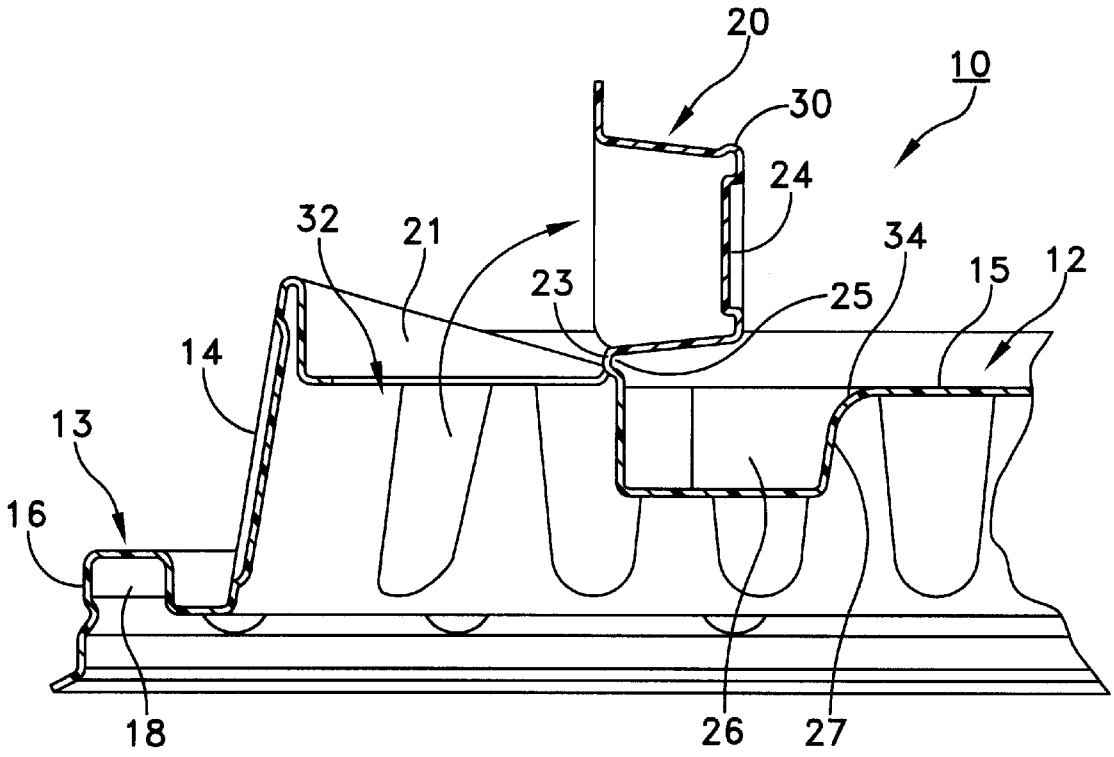
FIG. 10 is a partial detail view of the cross section shown in FIG. 10.

FIGS. 8–16 illustrate progressive stages of hinged portion 20 being released from the surrounding lid material and rotated about hinge 23 to an opened position in which the tab 23 is detachably engaged in recess 26. In FIGS. 8–10 the hinged portion 20 is shown rotated ninety (90) degrees out of the plane of central cover portion 12, in a direction indicated by arrow "B," thereby creating a drinking opening 32 in central cover portion 12.

Figure 11:
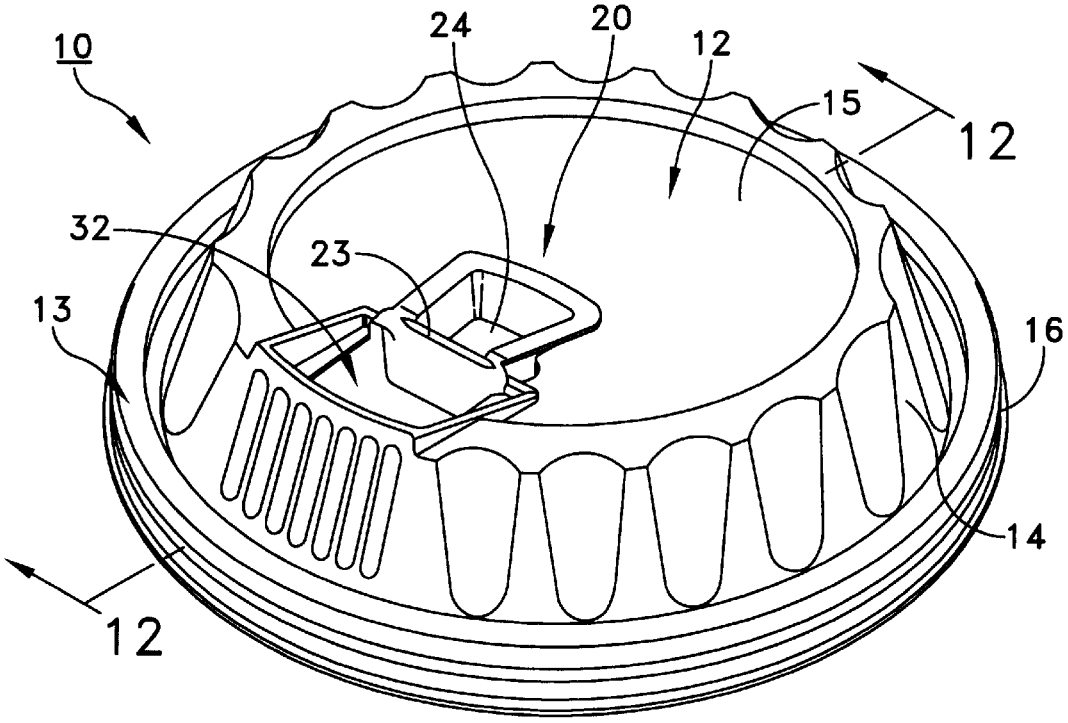
FIG. 11 is a front isometric view of the cup lid design, with the hinged portion rotated about its hinge so that the front edge of the tab contacts the back wall of the lid recess.
Figure 12:
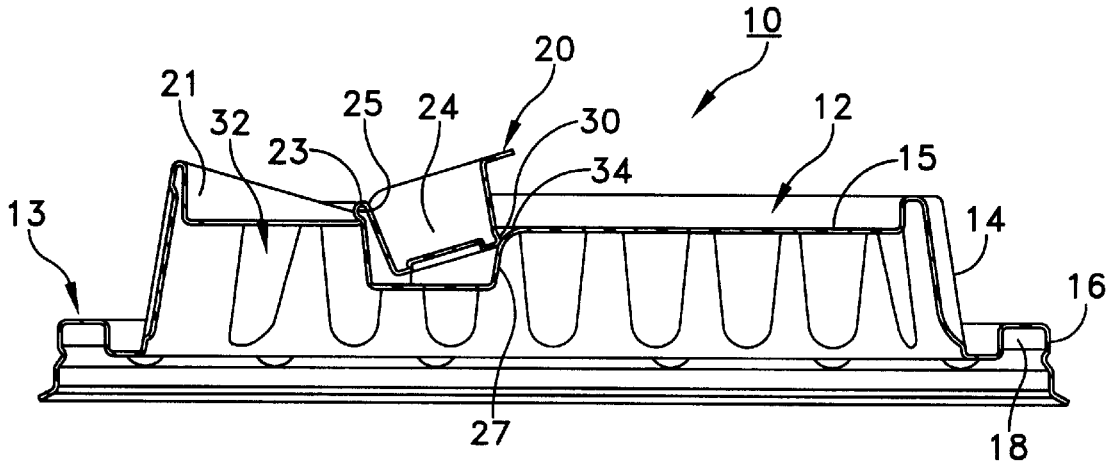
FIG. 12 is a cross sectional view of the lid shown in FIG. 11, taken along line 12—12.
Figure 13:
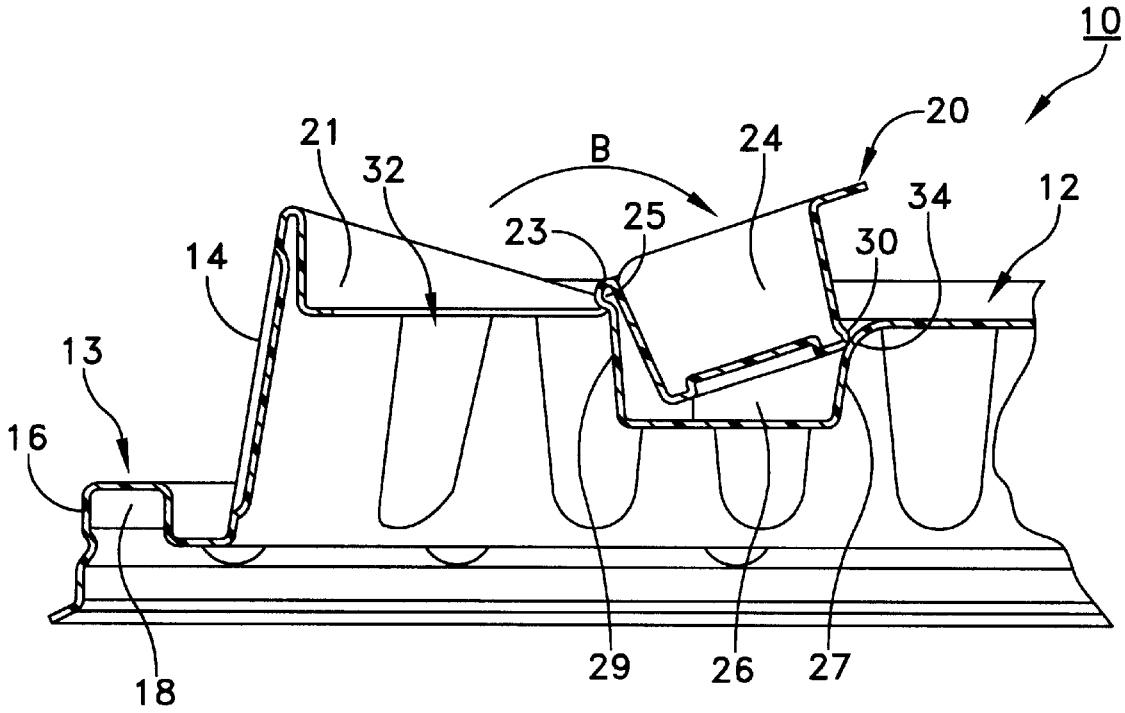
FIG. 13 is a partial detail view of the cross section shown in FIG. 10.

In FIGS. 11–13, hinged portion 20 has been rotated approximately one-hundred sixty (160) degrees out of its closed orientation in the plane of central cover portion 12. In this position, the protruding rib 30 formed on tab 24 is in contact with the top edge 34 of the back wall 27 of recess 26. As shown in the drawings, the top edge 34 of back wall 27 is provided with a tapered profile to facilitate insertion of the tab 24 into recess 26.

As the user presses the tab 24 into the recess 26, the protruding rib 30 of tab 24 frictionally engages the back wall 27 of the recess 26, resiliently displacing the back wall 27 of recess 26 so that it conforms to the rib 30 profile. This feature, illustrated in FIGS. 14–16, detachably locks the tab 24 in nested engagement with recess 26. It is further contemplated that the back wall 27 may be provided with a notch or detent to receive rib 30 in detachable locking engagement. Likewise, it will be appreciated that one or more pairs of complementary male and female engaging features may be provided in the tab 24 and/or the recess 26 to provide for detachable locking engagement therebetween.

Figure 14:
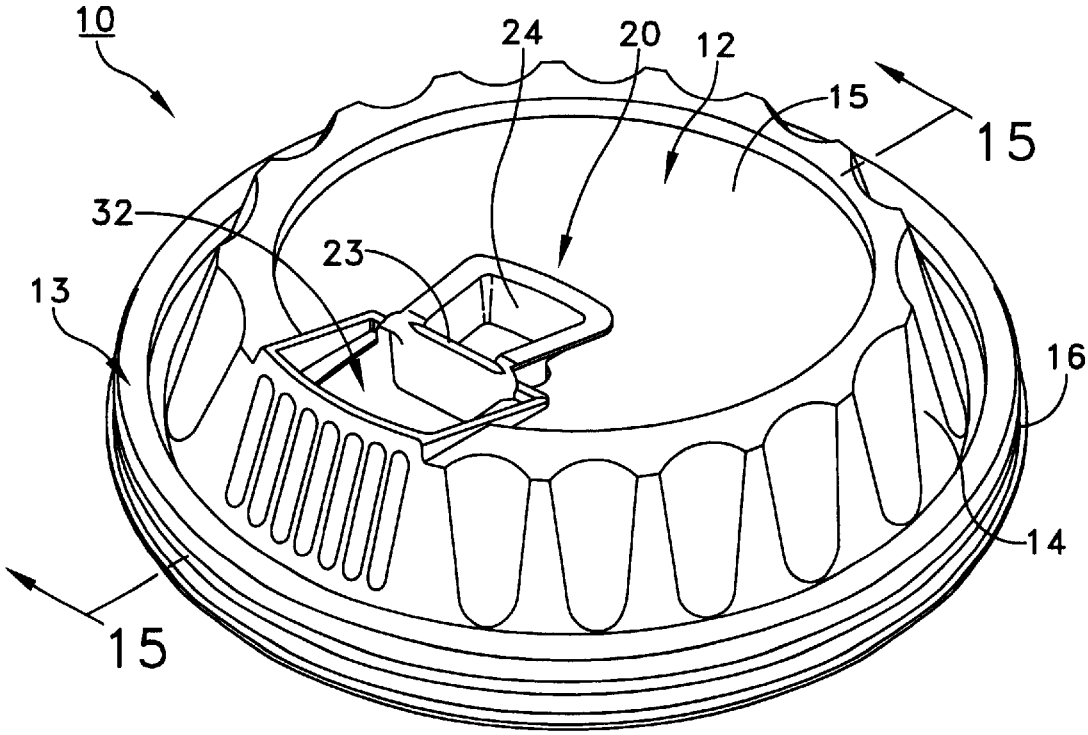
FIG. 14 is a front isometric view of an embodiment of a cup lid design according to the invention, with the tab of the hinged portion detachably locked in the lid recess.
Figure 15:
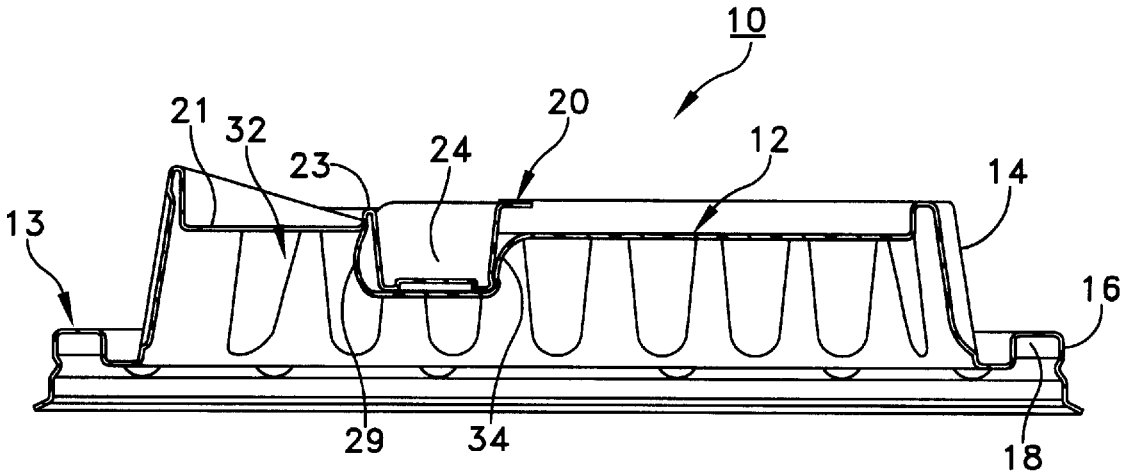
FIG. 15 is a cross sectional view of the lid shown in FIG. 14, taken along line 15—15.
Figure 16:
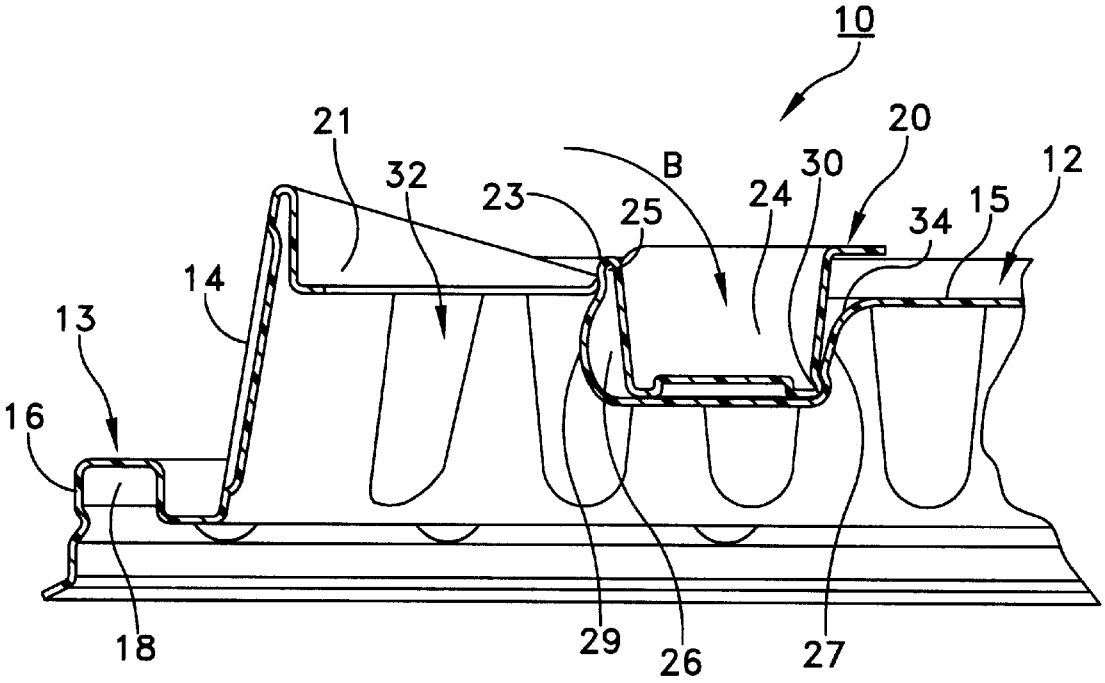
FIG. 16 is a partial detail view of the cross section shown in FIG. 15.

Advantageously, the nested tab 24, shown in FIGS. 14–16, is biased against the back wall 27 by hinge 23. In the embodiment shown, hinge 23 has an arc 25, which provides a biasing force that presses tab 24 against the back wall 27 of recess 26. The biasing of the tab 24 is further augmented by the resilient foreshortening of the back wall of recess 26 as the tab is pressed into locking engagement with recess 26. Such foreshortening or buckling laterally displaces hinge 23 toward the back wall 27 of recess 26, further biasing the tab 24 in recess 26. Alternative hinge configurations that provide a biasing action are also contemplated within the scope of the invention.

A number of advantages are achieved in accordance with the invention. The improved lid design has multiple modes of operation, wherein a hinged portion of the lid could be either resiliently pressed down into the lid, or manually rotated out of the plane of the lid, to provide a drinking opening. A protruding tab integrally formed on the hinged portion of the lid detachably engages a recess in the lid, and is retained in the recess by a biasing force of the hinge. The lid design is simple in construction and hence cost effective to manufacture using conventional vacuum forming and die cutting techniques.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

We claim:

1. A drink-through lid for use on a drinking cup comprising:

a lid having a central cover portion, the lid adapted to matingly engage the upper peripheral edge of a drinking cup so as to selectively maintain the lid in a covering relationship on the cup;

a hinged portion defined in the central cover portion of the lid, the hinged portion having a hollow raised tab integrally formed thereon, the hinged portion being selectively inwardly rotatable about an integrally formed hinge so as to provide a drinking opening in the lid, the tab having a rear wall terminating in said hinge; and a recess integrally formed on the central portion of the lid adjacent the integrally formed hinge, said recess comprising a foremost edge defined by said hinge, the hinged portion being selectively outwardly rotatable about the hinge such that the hollow raised tab is received in nested, detachably locking engagement in the recess.

2. The drink-through lid of claim 1 wherein the recess is resiliently deformable and the tab is adapted to be selectively at least partially received in detachably locking engagement in the recess.

3. The drink-through lid of claim 1 wherein a protruding rib is formed on a surface of the tab which is engageable with a complementary structure formed in the recess.

4. The drink-through lid of claim 1 wherein male and female complementary mating structures are formed in the tab and recess, respectively, for detachably lockingly engaging the tab in the recess.

5. The drink-through lid of claim 1 wherein the shape of the central cover portion is frusto-conical.

6. The drink-through lid of claim 1 wherein the hinged portion is defined by a substantially U-shaped slit formed in the central cover portion.

7. The drink-through lid of claim 1 wherein the hollow raised tab is substantially cube shaped.

8. The drink-through lid of claim 1 wherein the recess includes a notch which is substantially complementary to the protruding rib.

9. The drink-through lid of claim 1 wherein the hinged portion is disposed in a well provided on the central cover portion of the lid.

* * * * *